US009091435B2

(12) United States Patent
Jin et al.

(10) Patent No.: US 9,091,435 B2
(45) Date of Patent: Jul. 28, 2015

(54) TWO-CHAMBER GAS BURNER DEVICE

(76) Inventors: Weiqun Jin, Shenzhen (CN); Weidong Jin, Shenzhen (CN)

( * ) Notice: Subject to any disclaimer, the term of this patent is extended or adjusted under 35 U.S.C. 154(b) by 794 days.

(21) Appl. No.: 13/429,515

(22) Filed: Mar. 26, 2012

(65) Prior Publication Data

US 2013/0252186 A1 Sep. 26, 2013

(51) Int. Cl.

| | |
|---|---|
| ***F23D 14/14*** | (2006.01) |
| ***F23D 14/26*** | (2006.01) |
| ***F23D 14/08*** | (2006.01) |
| *F23Q 9/08* | (2006.01) |

(52) U.S. Cl.

CPC ..... *F23D 14/26* (2013.01); *F23D 14/08* (2013.01); *F23D 2203/102* (2013.01); *F23D 2900/00015* (2013.01)

(58) Field of Classification Search

CPC ..... F23D 14/14; F23D 14/30; F23Q 9/08
USPC ..... 431/281, 328, 329, 326; 126/214 A, 39 J, 126/39 C

See application file for complete search history.

(56) References Cited

U.S. PATENT DOCUMENTS

| | | | | | |
|---|---|---|---|---|---|
| 1,702,929 | A * | 2/1929 | Breese, Jr | ..... | 431/10 |
| 2,260,555 | A * | 10/1941 | Breese | ..... | 431/336 |
| 3,198,240 | A * | 8/1965 | Keith et al. | ..... | 431/329 |
| 3,310,098 | A * | 3/1967 | Hardison | ..... | 431/329 |
| 3,814,573 | A * | 6/1974 | Karlovetz | ..... | 431/329 |
| 4,039,275 | A * | 8/1977 | McGettrick | ..... | 431/329 |
| 4,595,356 | A * | 6/1986 | Gaysert et al. | ..... | 431/352 |
| 6,114,666 | A * | 9/2000 | Best | ..... | 219/411 |
| 8,919,336 | B2 * | 12/2014 | von Herrmann et al. | .... | 126/39 J |
| 2012/0240917 | A1 * | 9/2012 | Tolleneer | ..... | 126/116 R |

FOREIGN PATENT DOCUMENTS

| | | | | |
|---|---|---|---|---|
| FR | EP499557 A1 * | 8/1992 | ..... | F23D 14/30 |

* cited by examiner

*Primary Examiner* — Gregory Huson
*Assistant Examiner* — Nikhil Mashruwala
(74) *Attorney, Agent, or Firm* — Raymond Y. Chan; David and Raymond Patent Firm

(57) ABSTRACT

A two-chamber gas burner with a case body, a cavity, an opening, a burner plate, and a plate unit connected to an upper surface of the burner plate, comprising a first chamber and at least one second chamber freely positioned in and supplementary to the first chamber. The plate unit comprises a first plate member directly mounting the burner plate onto the case body by screw nut connector; and a second plate member on top of the burner plate and the first plate securely mounting the burner plate for the second chamber. The gas burner is compact, small, light and has a generally one-piece structure with safe lighting process and stable flame, thereby effectively solving the ignition and explosion problems in high pressure gas burner, and hence is particularly suitable for high pressure high heat value gas burner. Its wind resistance and flame extinction arrangement further stabilized the burning process.

12 Claims, 2 Drawing Sheets

TWO-CHAMBER GAS BURNER DEVICE

BACKGROUND OF THE PRESENT INVENTION

1. Field of Invention

The present invention relates to a burner device, and more particularly to a two-chamber gas burner device.

2. Description of Related Arts

At present, gas burner or furnace of different varieties with different designs are found in the market. The common feature is that the main burner and the pilot light are two different parts and the pilot light is a burning flame type. The drawback of having a burning flame as the pilot light is that if the ignition and burning process of the main burner is delayed, an explosion may be resulted. In view of this safety concern, there is still no pilot light arrangement which is suitable for use in high pressure gas burner. In addition, the appearance of a burning flame type pilot light is unmatchable to infrared burner or furnace, and cannot meet the need of a user.

SUMMARY OF THE PRESENT INVENTION

An object of the present invention is to provide a solution for the above problems in providing a two-chamber gas burner device.

Additional advantages and features of the invention will become apparent from the description which follows, and may be realized by means of the instrumentalities and combinations particular point out in the appended claims.

According to the present invention, the foregoing and other objects and advantages are attained by a two-chamber gas burner device or furnace, which includes a case body having a cavity opened through an opening, a burner plate directly covering the opening of the case body, and a plate unit connected to the burner plate through an upper surface of the burner plate.

The characteristics of this type of two-chamber gas burner device is to include a first chamber provided inside the cavity; at least one second chamber which is substantively smaller than the first chamber, each defining a small chamber, provided and received in the first chamber, wherein the at least one second chamber is supplementary to the first chamber and each the second chamber is freely to position in the first chamber.

The plate unit comprises a first plate member and a second plate member, wherein the first plate member is provided directly onto the burner plate such that the burner plate for the first chamber is biased by the first plate member directly and is mounted securely onto the case body, wherein the second plate member is provided on top of the burner plate and the first plate member such that the second plate member is biased against the burner plate through the first plate member to securely mounting the burner plate for the second chamber into position, thereby preventing any gas leaking from the second chamber to the first chamber.

In addition, the following is further provided to solve the technical problems mentioned above.

The second chamber is internally or externally provided to operatively connected to the first chamber.

The first chamber and the second chamber are connected by welding or by means of screw and nut fastening mechanism, such as a screw and nut fastener.

The first chamber and the second chamber are two independent enclosed chambers which are separate from each other. In other words, the first chamber and the second chamber are enclosed chambers and can be used independently or together at the same time. When the first chamber and the second chamber are used together, the second chamber is being lighted and the first chamber is then ignited through the porous ceramic burner plate which spread the flame from the second chamber to the first chamber, thereby effectively preventing explosion caused by gas leakage of the gas burner during ignition.

The first chamber is connected to a first guiding pipe. In particular, the first chamber is connected to the first guiding pipe by rivet. The first guiding pipe is arranged for pre-mixing combustion air and fuel gas and guiding the fuel gas from the main valve to enter into a mixing chamber.

The second chamber is connected to a second guiding pipe. In particular, the second chamber is connected to the second guiding pipe by rivet. The second guiding pipe is arranged for pre-mixing combustion air and fuel gas and guiding the fuel gas from the pilot valve to enter into a mixing chamber.

The case body further comprises a spoiler unit which is connected to the first chamber by welding. The spoiler unit is arranged for modifying or adjusting a flowing direction of the mixed gas of the combustion air and fuel gas entering the mixing chamber so as to ensure the degree of red heat of the porous ceramic burner plate is the same on the entire surface of the porous ceramic burner plate for providing an even burning effect.

The burner plate is formed by at least one burner plate member. If the second chamber is externally provided to the first chamber, the burner plate comprises a first burner plate unit for a pilot burner unit of the gas burner and a second burner plate unit for a main burner unit of the gas burner, wherein a distance between the first burner plate and the second burner plate is limited to a distance at which the first burner plate and the second burner plate are operatively communicated such that a flame is capable of being spread between the first burner plate and the second burner plate.

The burner plate is a porous ceramic burner plate, catalytic ceramic fiber burner plate, a sintered burner plate or a metal grid burner plate.

The two-chamber gas burner further comprising an electrode rod, a thermocouple and a safety valve operatively provided to the thermocouple, wherein the electrode rod and the thermocouple are installed to the burner plate at a position which is proximal to the second chamber. The electrode rod first ignites the second chamber and the flame then spreads from the second chamber to the first chamber. If the thermocouple detects that the flame goes out, the safety valve will shut off the gas supply to ensure a high safety level.

Compare to conventional arts, the present invention has the following advantages:

The gas burner is compact, small in size, light in weight and a generally one-piece structure. The lighting process is safe and the flame produced is stable, thereby effectively solving the ignition and explosion problems in high pressure gas burner. The gas burner is particularly suitable for high pressure and high heat value gas burner, and provides wind resistance and flame extinction arrangement which further stabilized the burning process. The present invention can utilize fuel gas such as liquefied petroleum gas and natural gas, can be used for gas heater or stove.

Still further objects and advantages will become apparent from a consideration of the ensuing description and drawings.

These and other objectives, features, and advantages of the present invention will become apparent from the following detailed description, the accompanying drawings, and the appended claims.

DETAILED DESCRIPTION OF THE PREFERRED EMBODIMENT

The present invention is further described in details through the following exemplary embodiments and accompany drawings.

Exemplary Embodiment 1

Figure 1:
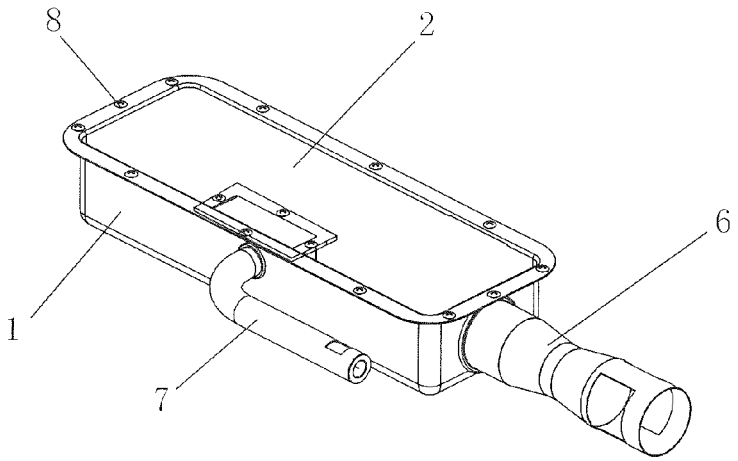
FIG. 1 is a perspective illustration of a gas burner according to a preferred embodiment of the present invention.
Figure 2:
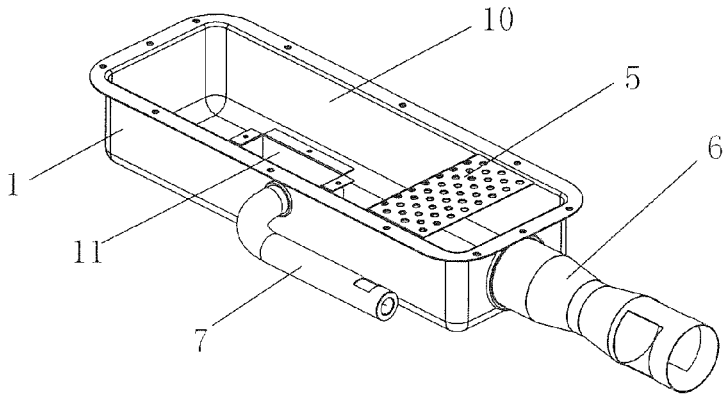
FIG. 2 is another perspective illustration of a gas burner before installation of burner plate and first and second plate members according to the above preferred embodiment of the present invention.
Figure 3:
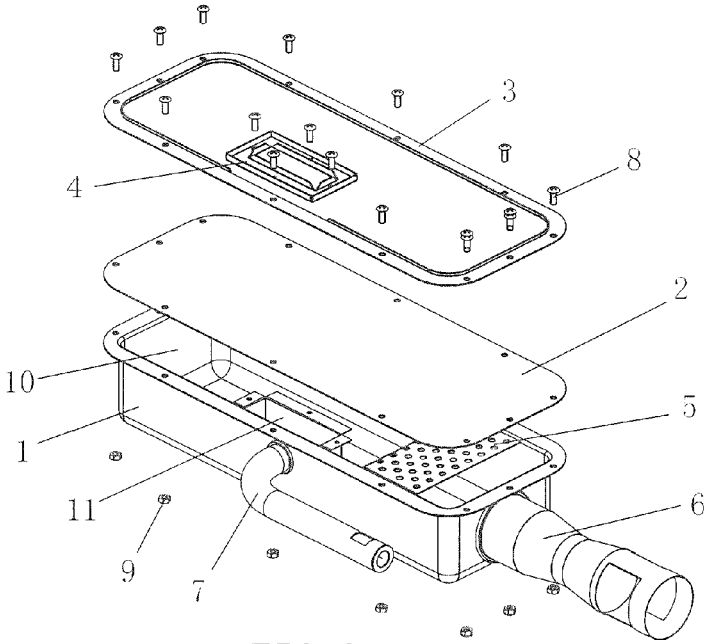
FIG. 3 is a partially exploded view illustration of a gas burner according to the above preferred embodiment of the present invention.

Referring to FIGS. 1 to 3 of the drawings, a two-chamber gas burner includes a case body 1 having a cavity with an opening, a combustion chamber provided in the cavity, a porous ceramic burner plate 2 directly covering the opening of the case body 1, a plate member such as a pressing plate or a connecting unit, an electrode rod and a thermocouple provided on a top surface of the porous ceramic burner plate 2, and a safety valve operatively connected to the thermocouple.

The case body 1 comprises a first chamber 10 and a second chamber 11 in the cavity of the case body 1, wherein a size of the second chamber 11 is smaller than a size of the first chamber 10 and the second chamber 11 is complement to the first chamber 10. In particular, the second chamber 11 is a small chamber provided in the cavity of the case body. Only a small portion of the cavity is used for the second chamber 11 and the majority of the cavity is used for providing the first chamber 10. The first chamber 10 and the second chamber 11 are connected by welding and are provided inside the case body 1 in such a manner that each of the first chamber 10 and the second chamber 11 is an enclosed chamber and can be used independently or together with the other chamber. When the first chamber 10 and the second chamber 11 are used together, the second chamber 11 is being lighted and the first chamber 10 is then ignited through the porous ceramic burner plate 2 which spread the flame from the second chamber 11 to the first chamber 10, thereby effectively preventing explosion caused by gas leakage of the gas burner during ignition. In addition, if the thermocouple detects that the flame goes out, the safety valve will shut off the gas supply to ensure a high safety level.

The first chamber 10 is connected to a first guiding pipe 6. In particular, the first chamber 10 is connected to the first guiding pipe 6 by rivet. The first guiding pipe 6 is arranged for pre-mixing combustion air and fuel gas and guiding the fuel gas from the main valve to enter into a mixing chamber.

The second chamber 11 is connected to a second guiding pipe 7. In particular, the second chamber 11 is connected to the second guiding pipe 7 by rivet. The second guiding pipe 7 is arranged for pre-mixing combustion air and fuel gas and guiding the fuel gas from the pilot valve to enter into a mixing chamber.

The case body further comprises a spoiler unit 5 which is connected to the first chamber 10 by welding. The spoiler unit 5 is arranged for modifying or adjusting a flowing direction of the mixed gas of the combustion air and fuel gas entering the mixing chamber so as to ensure the degree of red heat of the porous ceramic burner plate 2 is the same on the entire surface of the porous ceramic burner plate 2 for providing an even burning effect.

The plate unit comprises a first plate 3 and a second plate 4. The first plate 3 is positioned on top of the porous ceramic burner plate 2 directly and is arranged for securely mounting the porous ceramic burner plate 2 onto the case body 1 by means of screw and nut connection. The second plate 4 is positioned on top of the porous ceramic burner plate 2 and the first plate 3 and is secured into position by a screw unit 8 so as to prevent fuel gas leakage from the second chamber 11 to the first chamber 10.

Exemplary Embodiment 2

Figure 4:
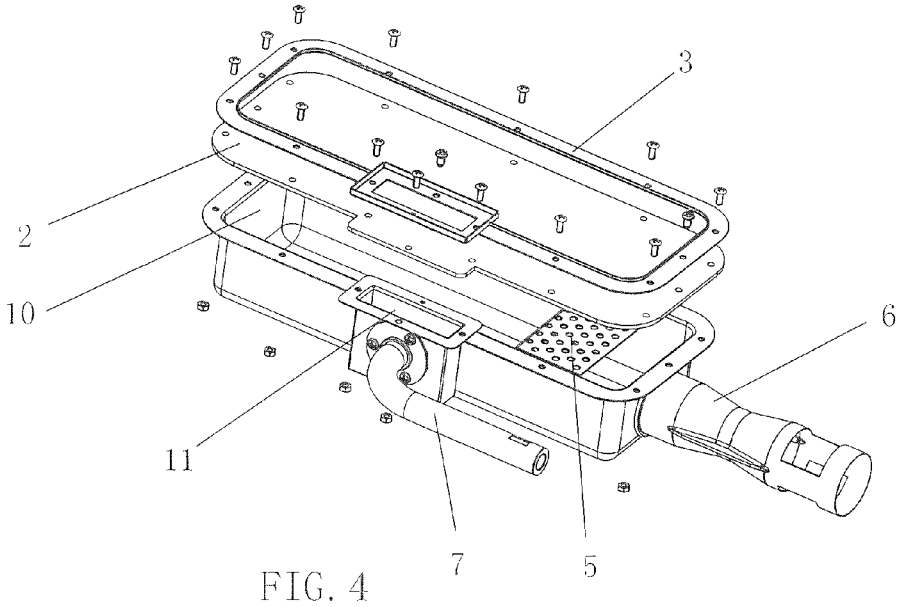
FIG. 4 is an illustration of the exemplary embodiment 2 of the gas burner according to the above preferred embodiment of the present invention.

Referring to FIG. 4 of the drawings, a two-chamber gas burner in this embodiment 2 is basically identical to the embodiment 1 as described above except that:

the gas burner includes a main burner unit and a pilot burner unit positioned below the main burner unit in such a manner that the main burner unit and the pilot burner unit are tightly interconnected so as to ensure a smooth ignition; and the gas burner also includes a two-unit burner plate which is a catalytic ceramic fiber burner plate, wherein the first chamber is connected to the second chamber by rivet.

The use of two-unit burner plate instead of a one-unit burner plate is advantageous in that: the pilot burner unit is separated from the first chamber and the gas is not bridged to flow between the pilot burner unit and the first chamber. But the drawback is inconvenience to assemble and the cost is relative high.

One skilled in the art will understand that the embodiment of the present invention as shown in the drawings and described above is exemplary only and not intended to be limiting.

It will thus be seen that the objects of the present invention have been fully and effectively accomplished. It embodiments have been shown and described for the purposes of illustrating the functional and structural principles of the present invention and is subject to change without departure from such principles. Therefore, this invention includes all modifications encompassed within the spirit and scope of the following claims.

What is claimed is:

1. A two-chamber gas burner which includes a case body having a cavity opened through an opening, a burner plate directly covering the opening of the case body, and a plate unit connected to the burner plate through an upper surface of the burner plate, comprising:

a first chamber provided inside the cavity;

at least one second chamber which is substantively smaller than said first chamber, provided and received in said first chamber, wherein said at least one second chamber is complement to said first chamber and is supplementary to said first chamber and each said second chamber is unrestricted to a particular position in said first chamber;

wherein said plate unit comprises a first plate member and a second plate member, wherein said first plate member is provided directly onto said burner plate such that said burner plate for said first chamber is biased by said first plate member directly and is mounted securely onto said case body, wherein said second plate member is provided on top of said burner plate and said first plate member such that said second plate member is biased against said burner plate through said first plate member to securely mounting said burner plate for said second chamber into position.

2. The two-chamber gas burner, as recited in claim 1, wherein said second chamber is internally or externally provided to operatively connected to said first chamber.

3. The two-chamber gas burner, as recited in claim 1, wherein said first chamber and said second chamber are connected by welding or by means of screw and nut fastening mechanism.

4. The two-chamber gas burner, as recited in claim 2, wherein said first chamber and said second chamber are connected by welding or by means of screw and nut fastening mechanism.

5. The two-chamber gas burner, as recited in claim 3, wherein said first chamber and said second chamber are two independent enclosed chambers which are separate from each other.

6. The two-chamber gas burner, as recited in claim 4 wherein said first chamber and said second chamber are two independent enclosed chambers which are separate from each other.

7. The two-chamber gas burner, as recited in claim 5, further comprising a first guiding pipe connecting to said first chamber by rivet connector.

8. The two-chamber gas burner, as recited in claim 6, further comprising a first guiding pipe connecting to said first chamber by rivet connector.

9. The two-chamber gas burner, as recited in claim 7, further comprising a second guiding pipe connecting to said second chamber by rivet connector.

10. The two-chamber gas burner, as recited in claim 8, further comprising a second guiding pipe connecting to said second chamber by rivet connector.

11. The two-chamber gas burner, as recited in claim 9, further comprising a spoiler unit mounted onto said first chamber by welding.

12. The two-chamber gas burner, as recited in claim 10, further comprising a spoiler unit mounted onto said first chamber by welding.

* * * * *